US009144913B2

(12) United States Patent
Gross et al.

(10) Patent No.: US 9,144,913 B2
(45) Date of Patent: Sep. 29, 2015

(54) HAIR CLIPPER BLADE GAPPING TOOL

(71) Applicant: ANDIS COMPANY, Sturtevant, WI (US)

(72) Inventors: Jeffrey D. Gross, Kenosha, WI (US); Richard J. Tringali, Racine, WI (US)

(73) Assignee: ANDIS COMPANY, Sturtevant, WI (US)

( * ) Notice: Subject to any disclaimer, the term of this patent is extended or adjusted under 35 U.S.C. 154(b) by 359 days.

(21) Appl. No.: 13/662,987

(22) Filed: Oct. 29, 2012

(65) Prior Publication Data

US 2014/0115865 A1 May 1, 2014

(51) Int. Cl.

| | |
|---|---|
| ***B26B 19/38*** | (2006.01) |
| *B26B 19/00* | (2006.01) |
| *B26B 19/20* | (2006.01) |
| *B26B 19/06* | (2006.01) |

(52) U.S. Cl.

CPC ..... *B26B 19/3893* (2013.01); *B26B 19/3846* (2013.01); *B26B 19/00* (2013.01); *B26B 19/06* (2013.01); *B26B 19/20* (2013.01); *B26B 19/38* (2013.01); *Y10T 29/49897* (2015.01); *Y10T 29/53978* (2015.01)

(58) Field of Classification Search

CPC ..... B26B 19/00; B26B 19/06; B26B 19/20; B26B 19/38; B26B 19/3893; B26B 19/3846; Y10T 29/49897; Y10T 29/53978

USPC ..... 33/641, 511–512, 501, 626, 628, 700, 33/832, 833; 29/434, 465, 281.5; 30/233, 30/537; D14/253; D8/373; 206/701, 349, 206/351–360, 372, 375

See application file for complete search history.

(56) References Cited

U.S. PATENT DOCUMENTS

| | | | | | |
|---|---|---|---|---|---|
| 2,304,525 | A | * | 12/1942 | Andis | 30/210 |
| 2,639,880 | A | * | 5/1953 | Belloff | 248/314 |
| 3,508,691 | A | * | 4/1970 | Langbehn | 224/248 |
| 4,122,600 | A | * | 10/1978 | Perry | 30/537 |
| 4,659,907 | A | * | 4/1987 | Andis et al. | 392/384 |
| 5,335,772 | A | * | 8/1994 | Chervenak et al. | 206/349 |
| 5,452,830 | A | * | 9/1995 | Hopkins et al. | 224/666 |
| D372,189 | S | * | 7/1996 | Andis et al. | D8/373 |
| 5,590,475 | A | * | 1/1997 | Andis | 34/97 |
| 6,729,517 | B2 | * | 5/2004 | Grover | 224/575 |
| 7,290,349 | B1 | * | 11/2007 | Carpenter | 33/628 |
| 7,350,314 | B2 | | 4/2008 | McCambridge et al. | |
| 2005/0067307 | A1 | * | 3/2005 | Kao | 206/349 |
| 2006/0112572 | A1 | * | 6/2006 | McCambridge et al. | 30/537 |
| 2012/0198716 | A1 | | 8/2012 | Tonges et al. | |

* cited by examiner

*Primary Examiner* — R. A. Smith
*Assistant Examiner* — Tania Courson
(74) *Attorney, Agent, or Firm* — Michael Best & Friedrich LLP

(57) ABSTRACT

A blade gapping tool for setting the gap of a hair clipper bladeset, the blade gapping tool including a base, a locking member, an adjustable boss and an adjuster.

15 Claims, 7 Drawing Sheets

HAIR CLIPPER BLADE GAPPING TOOL

BACKGROUND

The present invention relates generally to hair grooming tools and, more specifically, to a blade gapping tool used to set the gap on a hair clipper bladeset.

Hair trimmers typically use a bladeset having two blades, a fixed blade and a moving blade which laterally reciprocates relative to the fixed blade. The moving blade is coupled to a guide member using fasteners, while the guide member is slidingly coupled to the fixed blade. The distance between the tips of the teeth of the upper blade and the tips of the teeth of the lower blade is referred to as the bladeset gap. The bladeset gap is adjustable by moving the upper blade relative to the lower blade in a direction normal to the direction of reciprocation of the moving blade.

Hair clipper bladeset manufacturers usually assemble bladesets when the bladeset is manufactured. Users of hair trimmers may disassemble the bladeset to sharpen and/or clean the blades. Currently, bladesets are assembled manually which can be demanding due to the difficulty in holding the moving blade still relative to the fixed blade while using fasteners to fix the moving blade to the guide member. In addition, it can be difficult to obtain a consistent bladeset gap.

SUMMARY

In one embodiment, the invention provides a blade gapping tool having a base having first and second arms, an open space being disposed between the first and second arms, and an adjuster having a first adjusting arm, a second adjusting arm, and a sliding base portion sized and configured to slide in the open space between the first and second arms. The blade gapping tool also includes a locking member partially disposed in an interior of the base and configured to selectively bias the adjuster in a first direction.

In another embodiment the invention provides a blade gapping tool for setting the gap of a hair clipper bladeset, the tool including a base having a first blade tip stop configured to receive a cutting edge of a fixed blade of the hair clipper bladeset and a second blade tip stop configured to receive a cutting edge of a moving blade of the hair clipper bladeset. The tool further includes an adjustable boss partially disposed in an interior portion of the base and configured to bias the fixed blade towards the first blade tip stop, and an adjuster partially received in the base, the adjuster having a first arm able to push the moving blade towards the second blade tip stop.

In another embodiment the invention provides a method of setting the gap of a hair clipper bladeset, the method including the steps of providing a hair clipper bladeset having a fixed blade, a moving blade and a guide member, and also providing a blade gapping tool having a base, an adjuster and an adjustable boss, wherein the base includes a first blade tip stop and a second blade tip stop. The method further includes the steps of placing the bladeset on the base, biasing a cutting end of the fixed blade towards the first blade tip stop with the adjustable boss and a biasing member, and pushing a cutting end of the moving blade towards the second blade tip stop.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
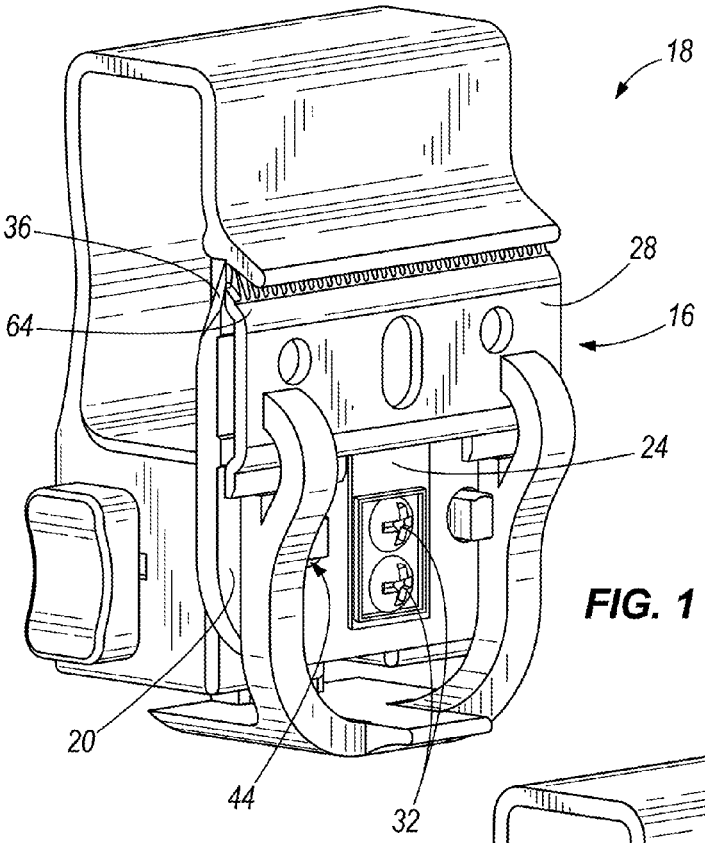
FIG. 1 is a perspective view of a blade gapping tool holding a bladeset.
Figure 2:
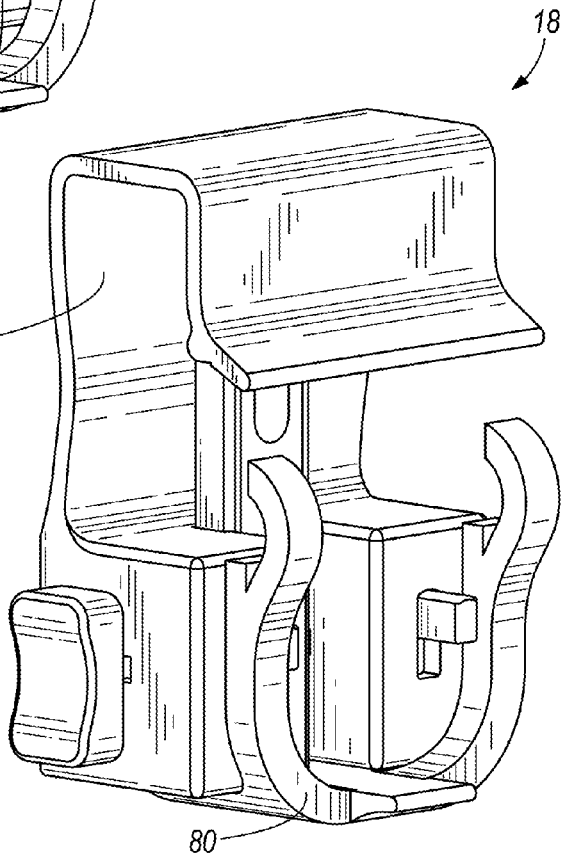
FIG. 2 is a perspective view of the blade gapping tool of FIG. 1, without the bladeset.

A hair clipper bladeset 16, shown in combination with a blade gapping tool 18 in FIG. 1, includes a fixed blade 20, a guide member 24, a moving blade 28, and fasteners 32. Such bladesets 16 are generally known in the art and are used with electric trimmers for the purpose of cutting hair.

The fixed blade 20 includes a cutting end 36, first openings 40 for receiving screws, bolts, or the like, and second openings 44 that allow screws, bolts, or the like to pass through a portion of the fixed blade 20. A toothed edge 48 is disposed on the cutting end 36. The first openings 40 are used in conjunction the fasteners 32 to couple the guide member 24 to the fixed blade 20. The second openings 44 may be used to couple the fixed blade 20 and/or the bladeset 16 to the electric trimmer. The attachment of the bladeset 16 to the electric trimmer is generally known in the art and is shown and described in U.S. Pat. No. 2,304,525, the entirety of which is hereby incorporated by reference.

The guide member 24 includes a fixing end 52 and a sliding end 56, the sliding end 56 being disposed proximate to the cutting end 36 of the fixed blade 20 when the bladeset 16 is assembled. The guide member 24 also includes at least one opening (not shown) disposed on the fixing end 52 to allow the fasteners 32 to pass therethrough to couple the guide member 24 to the fixed blade 20. The opening (not shown) is elongated to allow the guide member 24 to be moved closer or further to the cutting end 36 of the fixed blade 20, while still being fixable in place. The sliding end 56 is sized and configured to allow the moving blade 28 to slide along the sliding end 56 relative to the guide member 24 while still being slidingly coupled to the guide member 24.

The moving blade 28 includes a cutting end 64, a toothed edge 68 disposed on the cutting end 64, and a drive opening 72. The driving opening 72 is sized and configured to receive a driving member of the electric trimmer when the bladeset 16 is coupled to the electric trimmer, such that the driving member of the electric trimmer drives the moving blade 28 causing the moving blade 28 to reciprocate. The moving blade 28 is also sized and configured so that it may be slidingly coupled to the guide member 24, thus allowing the moving blade 28 to reciprocate relative to the fixed blade as is generally known in the art.

The blade gapping tool 18 is used to assist a user in adjusting or setting the gap of the hair clipper bladeset 16. The gap of the hair clipper bladeset 16 is the distance between the toothed edge 68 of the moving blade 28 and the toothed edge 48 of the fixed blade 20. Some users prefer that the hair clipper bladeset 16 have a small gap in order to facilitate more precise cutting as may be required for certain haircuts. Other users prefer that the gap be zero or very close to zero to facilitate very precise cutting. It is important that the gap remain zero or positive such that the toothed edge 68 of the moving blade 28 is closer to the fixing end 52 of the guide member 24 than the toothed edge 48 of the fixed blade 20. If the gap becomes negative such that the toothed edge 68 of the moving blade 28 is further away from the fixing end 52 of the guide member 24 than the toothed edge 48 of the fixed blade 20, then the bladeset 16 may pinch or bite the skin of the person receiving a haircut. Some embodiments of the blade gapping tool 18 are sized and configured to allow the user to set the gap of the hair clipper bladeset 16 to zero. Other embodiments of the blade gapping tool 18 are sized and configured to allow the user to set a small blade gap.

Figure 3:
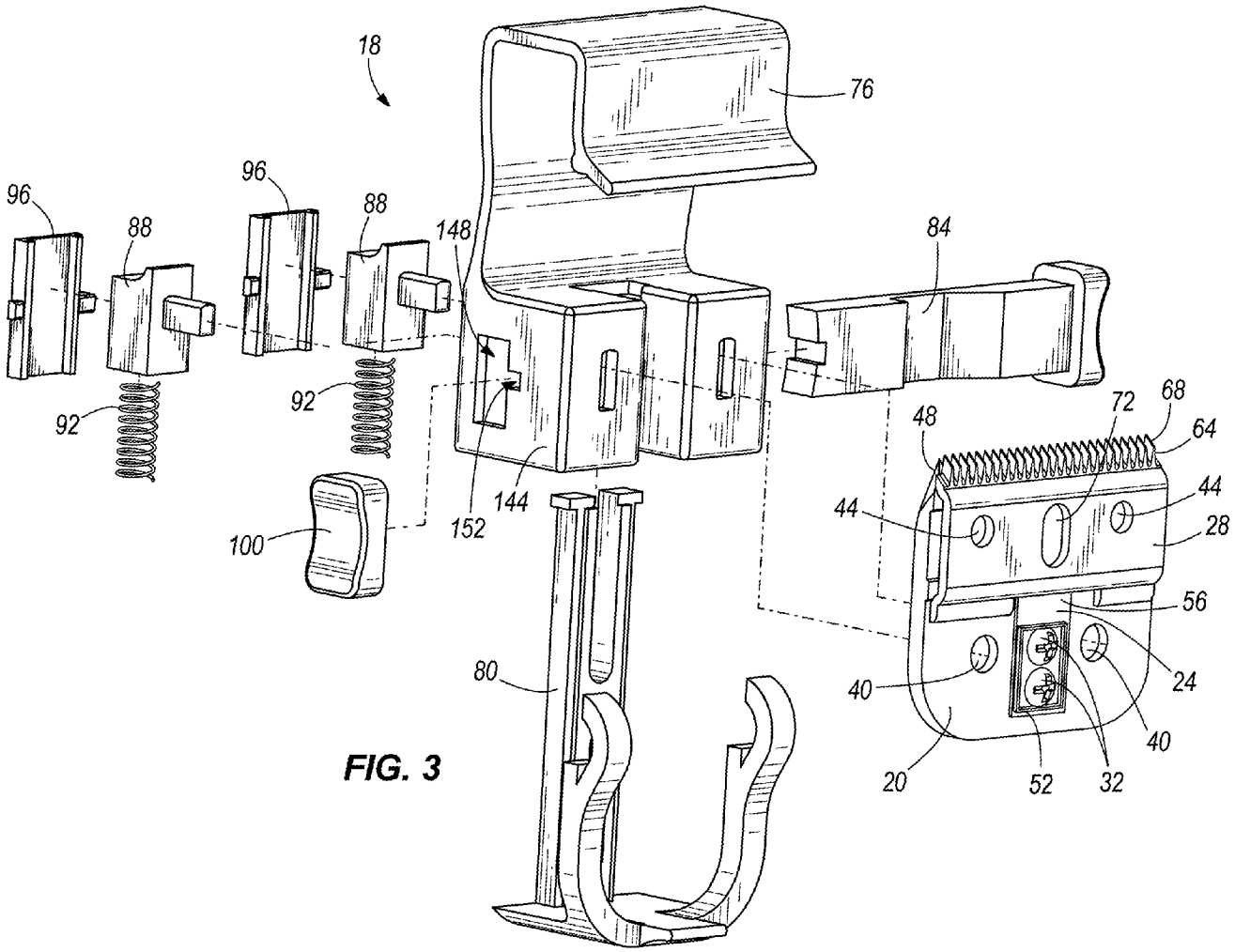
FIG. 3 is an exploded view of the blade gapping tool of FIG. 1, including a perspective view of the bladeset of FIG. 1.

The blade gapping tool 18, shown in exploded view in FIG. 3, includes a base 76, an adjuster 80, a locking member 84, at least one adjustable boss 88, at least one biasing member 92 and at least one pocket cover 96. In some embodiments the blade gapping tool 18 may include a glamour cap 100.

Figure 4:
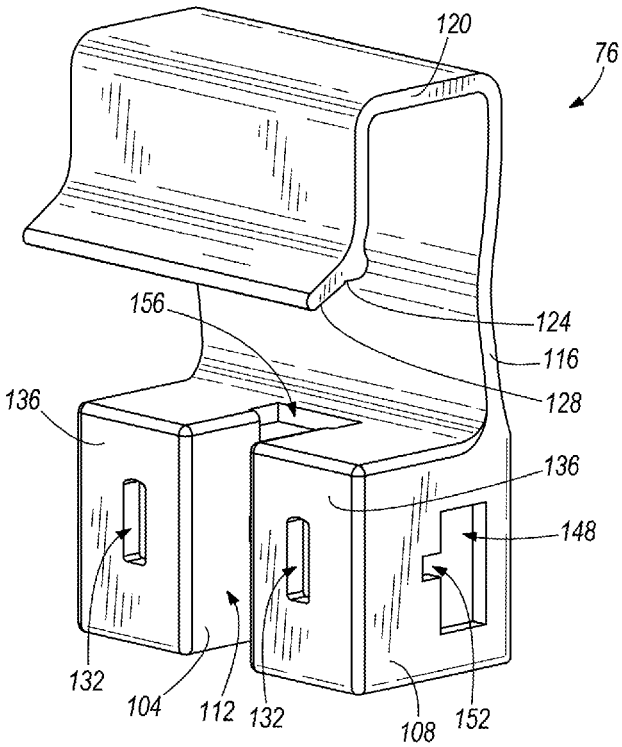
FIG. 4 is a perspective view of a base of the blade gapping tool of FIG. 1.

The base 76, illustrated in FIG. 4, includes a first arm 104, a second arm 108, an open space 112, a bottom portion 116, a u-shaped portion 120, a first blade tip stop 124 and a second blade tip stop 128. The first arm 104 and second arm 108 are symmetrical, so only the first arm 104 will be described. An opening 132 is disposed on a top surface 136 of the first arm 104 to allow a portion of the adjustable boss 88 to pass through. The opening 132 is oblong in shape, but may also be elliptical or rectangular in shape. An interior 140 of the first arm 104 includes an open space sized and configured to receive the adjustable boss 88. An outer side surface 144 of the first arm 104, best shown in FIG. 3, includes a slot 148 disposed thereon, the slot 148 being sized and configured to receive a portion of the locking member 84 and a portion of the pocket cover 96. The slot 148 generally forms the shape of a rectangle, with a notch 152 disposed on one side of the slot 148. The notch 152 is sized and configured to receive a portion of the pocket cover 96. Disposed proximate to the open space 112 is a cutout 156 disposed proximate to the bottom portion 116, the cutout 156 being sized and configured to allow a portion of the adjuster 80 to pass therethrough. The open space 112 is bounded on one side by the first arm 104, is bounded on another side by the second arm 108, is bounded on another side by the bottom portion 116, while the remaining three sides are open. The size and configuration of the first arm 104 and the second arm 108 are such that a portion of the adjuster 80 may fit in the open space. The bottom portion 116 couples the first arm 104 and second arm 108 to the u-shaped portion 120. The u-shaped portion 120 couples the bottom portion 116 to the first and second blade tip stops 124, 128. The bottom portion 116 and u-shaped portion 120 are sized and configured to allow the fixed blade 20 to fit between the first blade tip stop 124 and the openings 132. The first blade tip stop 124 is approximately in the shape of a "V", the first blade tip stop 124 being sized and configured to receive the toothed edge 48 of the fixed blade 20. The second blade tip stop 128 extends from one side of the first blade tip stop 124, the second blade tip stop 128 being angled such that the toothed edge 68 of the moving blade 28 is biased towards the toothed edge 48 of the fixed blade 20 when the blade gapping tool 17 is being used to set the gap on the bladeset 16.

Figure 5:
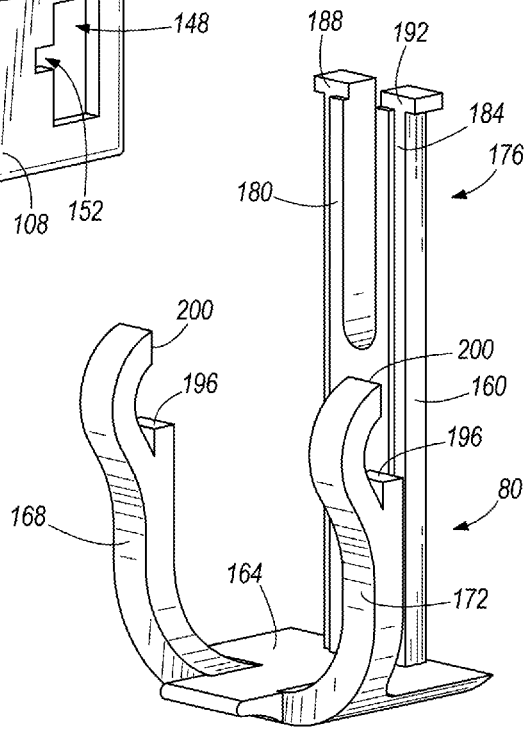
FIG. 5 is a perspective view of an adjusting arm of the blade gapping tool of FIG. 1.

The adjuster 80, illustrated in FIG. 5, includes a sliding base 160, a back 164, a first adjusting arm 168 and a second adjusting arm 172. The sliding base 160 is coupled to the back 164, the sliding base 160 including a u-shaped portion 176. The u-shaped portion 176 includes a first arm 180 and a second arm 184. The u-shaped portion 176 is configured such that the base of the "u" is closest to the back 164, while the first and second arms 180, 184 are further away from the back 164. The u-shaped portion 176 includes first and second projections 188, 192, the first projection 188 disposed on the first arm 180 and the second projection 192 disposed on the second arm 184. The u-shaped portion 176 is sized and configured so that it may pass through the open space 112 and notch 156 of the base 76. In some embodiments the first and second arms 180, 184 of the u-shaped portion 176 must be pressed towards each other so that the u-shaped portion 176 can pass through the open space 112. The first and second projections 188, 192 are sized and configured such that when the adjuster 80 has been installed on the base 76, the first and second projections 188, 192 in cooperation with the first arm 104 and second arm 108 inhibit the adjuster 80 from being uncoupled from the base 76. The back 164 of the adjuster 80 couples the sliding base 160 to the first and second adjusting arms 168, 172. The back 164 is sized and configured to allow a user to press on the back 164 in order to slide the first and second adjuster arms 168, 172 towards the second blade tip stop 128. In one embodiment, a portion of the adjuster 80 that interfaces with the locking member 84 is beveled.

The adjuster 80 includes the first adjusting arm 168 and second adjusting arm 172 which are symmetrical, so only the first adjusting arm 168 will be described. The first adjusting arm 168 is coupled to the back 164 and includes a horizontal pressing portion 196 and a vertical pressing portion 200. The horizontal pressing portion 196 may be used to push the moving blade 28 towards the second blade tip stop 128. The vertical pressing portion 200 may be used to push the moving blade 28 towards the fixed blade 20.

Figure 6:
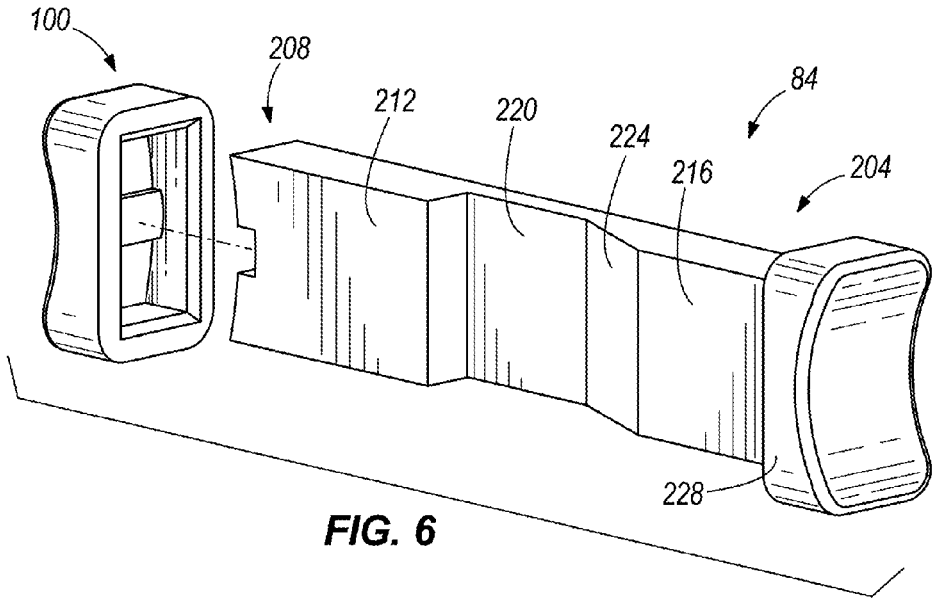
FIG. 6 is a perspective view of a locking arm and a glamour cap of the blade gapping tool of FIG. 1.

The locking member 84, illustrated in FIG. 6, includes a button end 208, a receiving end 204, a first biasing surface 212, a second biasing surface 216, a receiving surface 220, and a sliding surface 224. The button end 208 is sized and configured to receive the glamour cap 100. The receiving end 204 includes a collar portion 228 to prevent the receiving end 204 from entering into the interior portion of the base 76. The first biasing surface 212 may be used to bias the adjustable boss 88 towards the top surface 136 of the base 76. The second biasing surface 216 may be used to bias the adjustable boss 88 towards the top surface 136 of the base 76. The sliding surface 224 is sized and configured to bias the adjuster 80 towards the top surface 136 of the base 76.

Figure 6A:
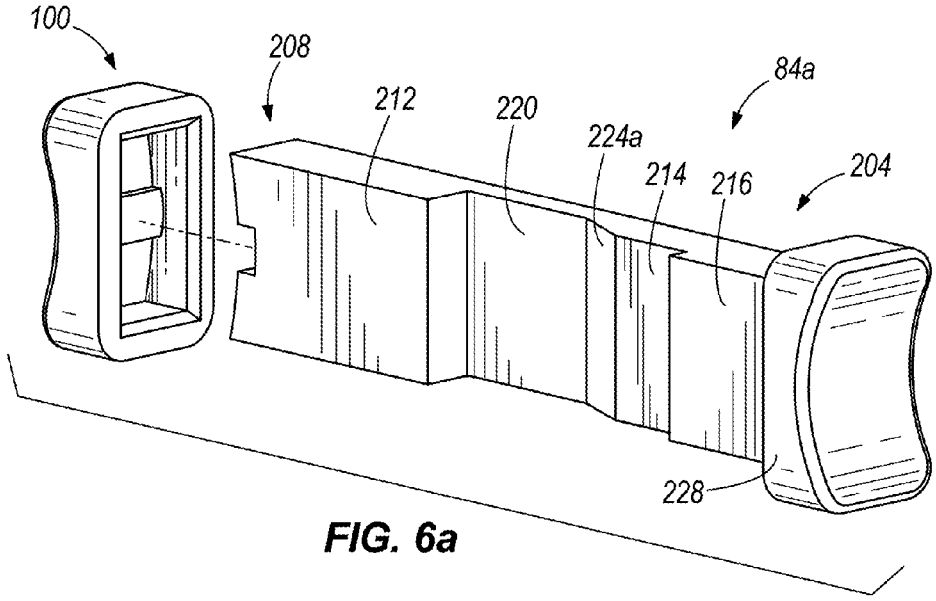
FIG. 6*a* is a perspective view of a locking arm and a glamour cap of the blade gapping tool according to an alternate embodiment.

An alternative embodiment of the locking member **84*a*, illustrated in FIG. 6*a* includes a shelf 214. Many aspects of the locking member 84 illustrated in FIG. 6*a* are similar to the locking member 84 illustrated in FIG. 6; only the differences will be described herein. The shelf 214 is sized and configured to interface with the adjuster 80, and serves to bias the adjuster 80 towards the top surface 136 of the base 76. The sliding surface 224*a* assists the user in assembling the locking member 84*a* and the adjuster 80 such that the adjuster 80 is able to move along the sliding surface 224*a* until the adjuster 80 partially or completely rests on the shelf 214. This combination of the shelf 214 and sliding surface 224*a* allows the adjuster 80 to snap into place with regard to the locking member 84***a*, making the adjuster 80 more secure with respect to the locking member 84*a*.

Figure 7:
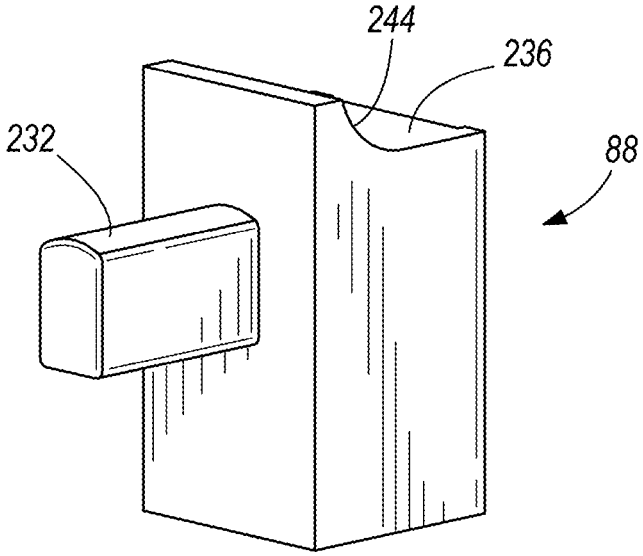
FIG. 7 is a perspective view of an adjustable boss of the blade gapping tool of FIG. 1.
Figure 10:
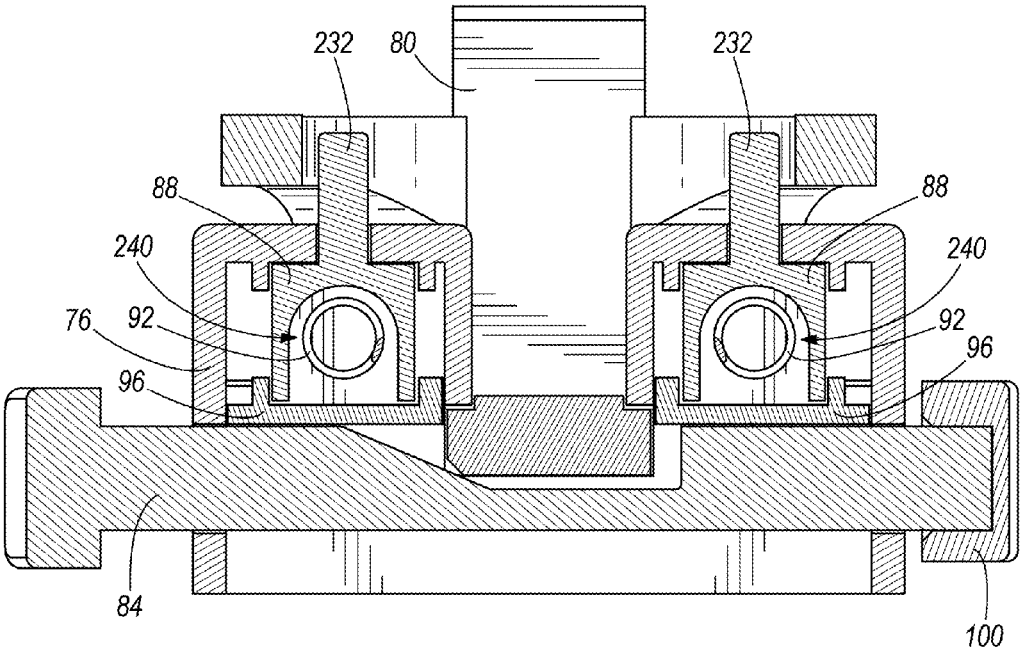
FIG. 10 is a section view of the blade gapping tool of FIG. 1, taken along line 10-10.

The adjustable boss 88, illustrated in FIG. 7, includes a projecting member 232, a front wall 236, and an interior cavity 240 (shown in FIG. 10). The projecting member 232 is sized and configured to fit through the opening 132 of the base 76. In addition, the projecting member 232 is sized and configured to fit through the second opening 44 in the lower blade 20. The front wall 236 provides a partial boundary for the interior cavity 240; the front wall 236 also includes a curved portion 244. The interior cavity 240 is sized and configured to receive the biasing member 92. The biasing member 92 may be a coil spring or the like. The biasing member 92 provides a biasing force between the front wall 236 and the base 76 in order to bias the projecting member 232 towards the 1$^{st}$ blade tip stop 124. In the illustrated embodiment two adjustable bosses 88 are used, but some embodiments may include only a single adjustable boss 88.

Figure 8:
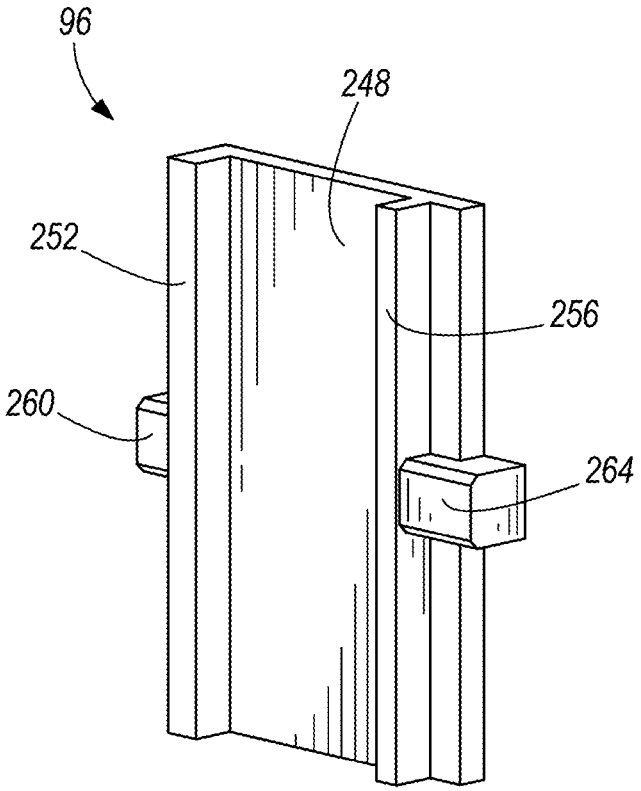
FIG. 8 is a perspective view of a pocket cover of the blade gapping tool of FIG. 1.
Figure 9:
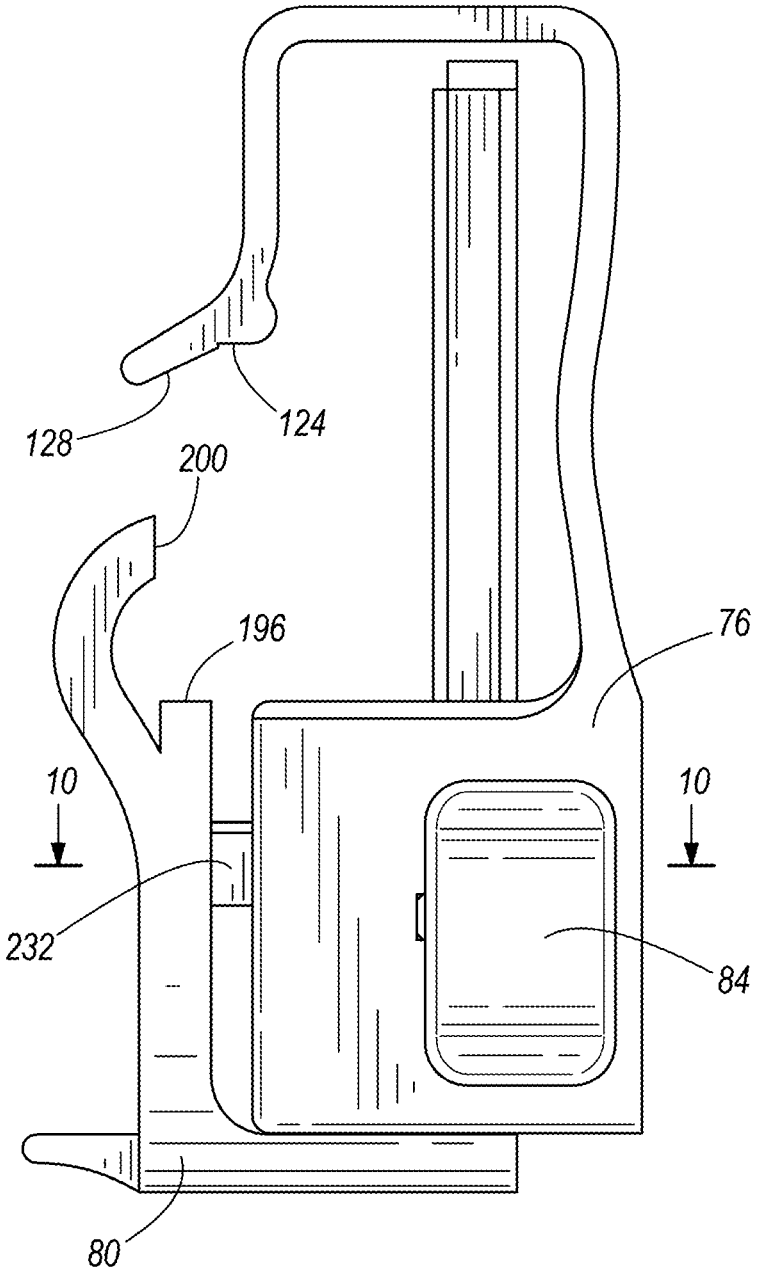
FIG. 9 is a side view of the blade gapping tool of FIG. 1.

The pocket cover 96, illustrated in FIG. 8, includes a floor 248, a first wall 252, a second wall 256, a first arm 260, and a second arm 264. The floor 248 is substantially flat. The first wall 252 extends from the floor 248. The second wall 256 extends from the floor 248. The floor 248, first wall 252, and second wall 256 are sized and configured such that a portion of the adjustable boss 88 can be in contact with the floor 248 between the first wall 252 and the second wall 256. The first arm 260 extends from the first wall 252 and the second arm 264 extends from the second wall 256. The first arm 260 and second arm 264 are sized and configured to be received in corresponding openings 152 of the base 76. In the illustrated embodiment the adjustable boss 88 and pocket cover 96 are separate pieces for ease of manufacturing. In other embodiments the adjustable boss 88 and pocket cover 96 may be one piece.

The glamour cap 100, shown in FIG. 6, is sized and configured to fit on the button end 208 of the locking member 84. In the illustrated embodiment the glamour cap 100 is press fit on the button end 208. In other embodiments the glamour cap 100 may be coupled to the button end 208 using a mechanical fastener, an epoxy, or by chemically bonding the two pieces. The glamour cap 100 assists in retaining the locking member 84 in the base 76.

The blade gapping tool 18 may be assembled as follows. The biasing members 92 (if two biasing members and two adjustable bosses 88 are used) are inserted into the interior cavities 240 of the adjustable bosses 88. Next, the biasing members 92 and adjustable bosses 88 are inserted into the first and second arms 104, 108 of the base 76. After that the pocket covers 96 are placed next to the adjustable bosses 88 such that a portion of the adjustable bosses 88 rests on the floor 248 of the pocket cover 96, and the first and second arms 260, 264 of the pocket cover 96 fit into the corresponding openings 152 on the base 76. Next, the locking member 84 is inserted into the base 76, the locking member 84 thus holding the biasing members 92, adjustable bosses 88, and pocket covers 96 in place. Following that the adjuster 80 is insert into the base 76. In some embodiments the first and second arms 180, 184 of the u-shaped portion 176 may need to be squeezed together to fit through the open space 112 of the base 76. In addition, the locking member 84 may need to be moved slightly to allow the adjuster 80 to pass by the locking member 84. Finally, the glamour cap 100 is pressed on to the locking member 84.

The bladeset spacing of a hair clipper bladeset 16 may be set as follows. The guide member 24 is coupled to the lower blade 20 such that the guide member 24 may move relative to the lower blade 24. Next, the upper blade 28 is slid onto the guide member 24 such that the upper blade 28 is coupled to the guide member 24 while still being able to reciprocate relative to the guide member 24 and lower blade 20. At this point the bladeset 16 should be placed in the blade gapping tool 18. The adjuster 80 may need to be pulled away from the first blade tip stop 124 to allow the bladeset 16 to fit onto the blade gapping tool 18. The bladeset 16 should be placed such that the projecting members 232 of the adjustable bosses 88 fit into the second openings 44 disposed on the lower blade 20. Once the projecting members 232 of the adjustable bosses 88 are inserted into the second openings 44 disposed on the lower blade 20, the biasing members 92 serve to bias the cutting end 36 of the lower blade 20 towards the first blade tip stop 124. Next, the adjuster 84 is moved by the user towards the second blade tip stop 128. The vertical pressing portions 200 of adjuster 80 serve to bias the upper blade 28 towards the lower blade 20. The horizontal pressing portions 196 of the adjuster 80 serve to bias the cutting end 64 of the upper blade 28 towards the second blade tip stop 128. Thus the lower blade 20 is biased toward the first blade tip stop 124 and the upper blade 28 is biased towards the second blade tip stop 128. Finally, the screws 32 holding the guide member 24 to the lower blade 20 are tightened such that the guide member 24 is inhibited from moving relative to the lower blade 20. The size and configuration of the first blade tip stop 124 relative to the second blade tip stop 128 serves to set the bladeset spacing between the upper blade 28 and the lower blade 20. At this point the bladeset spacing is set, and the bladeset 16 may be removed from the blade gapping tool 18 by pulling the bladeset 16 away from the base 76 of the blade gapping tool 18.

In an alternative embodiment the second blade tip stop 128 is adjustable relative to the first blade tip stop 124, by using a hinge or the like, such that the bladeset spacing set by the blade gapping tool 18 is adjustable.

Thus, the invention provides, among other things, a blade gapping tool. Various features and advantages of the invention are set forth in the following claims.

What is claimed is:

1. A blade gapping tool comprising:

a base having first and second arms, an open space being disposed between the first and second arms;

an adjuster having a first adjusting arm, a second adjusting arm, and a sliding base portion sized and configured to slide in the open space between the first and second arms; and a locking member partially disposed in an interior of the base and configured to selectively bias the adjuster in a first direction.

2. The blade gapping tool of claim 1, wherein the locking member includes a sloped section to bias the adjuster in the first direction.

3. The blade gapping tool of claim 1, wherein the base includes a first blade tip stop and a second blade tip stop, the second blade tip stop being offset from the first blade tip stop.

4. The blade gapping tool of claim 1, further comprising an adjustable boss partially disposed in a cavity of the second arm, a projecting member of the adjustable boss being configured to pass through an opening in a fixed hair clipper blade.

5. The blade gapping tool of claim 4, further comprising a pocket cover disposed proximate to the adjustable boss, the pocket cover inhibiting the adjustable boss from leaving the cavity of the second arm.

6. The blade gapping tool of claim 5, wherein the pocket cover and adjustable boss are captured in the cavity of the second arm by the locking member.

7. The blade gapping tool of claim 1, wherein the adjuster includes a vertical pressing portion to press a moving hair clipper blade in a second direction, the second direction being opposite of the first direction.

8. The blade gapping tool of claim 7, wherein the adjuster includes a horizontal pressing portion to press the fixed blade in a third direction, the third direction being perpendicular to the first direction.

9. A blade gapping tool for setting a gap of a hair clipper bladeset, the tool comprising:

a base having a first blade tip stop configured to receive a cutting edge of a fixed blade of the hair clipper bladeset and a second blade tip stop configured to receive a cutting edge of a moving blade of the hair clipper bladeset;

an adjustable boss partially disposed in an interior portion of the base and configured to bias the fixed blade towards the first blade tip stop; and an adjuster partially received in the base, the adjuster having a first arm able to push the moving blade towards the second blade tip stop.

10. The blade gapping tool of claim 9, wherein the first arm of the adjuster is configured to inhibit the moving blade from moving away from the fixed blade.

11. The blade gapping tool of claim 10, wherein the adjuster has a second arm, the second arm being able to push the moving blade towards the second blade tip stop and inhibit the moving blade from moving away from the fixed blade.

12. The blade gapping tool of claim 9, further comprising a locking member, the locking member being partially received in the base and further inhibiting the adjustable boss from leaving the interior portion of the base.

13. The blade gapping tool of claim 9, wherein the adjuster includes a U-shaped portion, the U-shaped portion having projections disposed thereon to inhibit the adjuster from being separated from the base.

14. The blade gapping tool of claim 9, wherein the adjustable boss includes a projecting portion, the projecting portion being receivable in an opening of the fixed blade.

15. The blade gapping tool of claim 9, further comprising a biasing member partially disposed in an interior cavity of the adjustable boss.

* * * * *